US005214235A

United States Patent [19]

Froeschner

[11] Patent Number: 5,214,235

[45] Date of Patent: May 25, 1993

[54] SHOCK DESTRUCTION ARMOR SYSTEM

[75] Inventor: Kenneth E. Froeschner, Livermore, Calif.

[73] Assignee: The United States of America as represented by the United States Department of Energy, Washington, D.C.

[21] Appl. No.: 856,260

[22] Filed: Mar. 25, 1992

[51] Int. Cl.[5] ..... F41H 5/04

[52] U.S. Cl. ..... 89/36.13; 89/36.02; 89/36.08

[58] Field of Search ..... 89/36.02, 36.08, 36.11, 89/36.12; 109/49.5, 80; 114/12, 14; 244/121, 158 R

[56] References Cited

U.S. PATENT DOCUMENTS

| | | | |
|---|---|---|---|
| 194,053 | 8/1877 | Rowlinson | 89/36.02 |
| 663,961 | 12/1900 | Donaldson | 89/36.02 |
| 787,065 | 4/1905 | White | 89/36.02 |
| 2,279,110 | 4/1942 | Collins | 89/36.02 |
| 2,321,039 | 8/1943 | Nelson | 89/36.02 |
| 2,380,393 | 7/1945 | Berg | 89/36.02 |
| 3,962,976 | 6/1976 | Kelsey | 89/36.02 |
| 4,300,439 | 11/1981 | Degnan et al. | 89/36.02 |
| 4,323,000 | 4/1982 | Dennis et al. | 89/36.02 |
| 4,398,446 | 8/1983 | Pagano et al. | 89/36.08 |
| 4,813,334 | 3/1989 | Bloks et al. | 89/36.02 |
| 5,067,388 | 11/1991 | Crews et al. | 89/36.02 |

FOREIGN PATENT DOCUMENTS

| | | | |
|---|---|---|---|
| 209221 | 1/1987 | European Pat. Off. | 89/36.02 |
| 1135342 | 8/1962 | Fed. Rep. of Germany | 89/36.02 |
| 2151015 | 4/1973 | Fed. Rep. of Germany | 189/36.02 |
| 866796 | 9/1941 | France | 89/36.02 |
| 444568 | 3/1936 | United Kingdom | 89/36.02 |

OTHER PUBLICATIONS

Richardson et al, "Development of Dual Bumper Wall Construction for Advanced Spacecraft", Journal of Spacecraft and Rockets, vol. 9, No. 6, Jun. 1972, pp. 448–451.

*Primary Examiner*—Stephen C. Bentley

*Attorney, Agent, or Firm*—Henry P. Sartorio; Roger S. Gaither; William R. Moser

[57] ABSTRACT

A shock destruction armor system is constructed and arranged to destroy the force of impact of a projectile by shock hydrodynamics. The armor system is designed to comprise a plurality of superimposed armor plates each preferably having a thickness less than five times the projectile's diameter and are preferably separated one-from-another by a distance at least equal to one-half of the projectile's diameter. The armor plates are effective to hydrodynamically and sequentially destroy the projectile. The armor system is particularly adapted for use on various military vehicles, such as tanks, aircraft and ships.

19 Claims, 2 Drawing Sheets

SHOCK DESTRUCTION ARMOR SYSTEM

ACKNOWLEDGEMENT

The United States Government has rights in this invention pursuant to Contract No. W-7405-ENG-48 between the U.S. Department of Energy and the University of California, for the operation of Lawrence Livermore National Laboratory.

BACKGROUND OF THE INVENTION

1. Field of Invention

This invention relates generally to an armor system and more particularly to an armor system for military vehicles and the like comprising a plurality of armor plates adapted to destroy a long rod penetrator or shaped-charged jet by the principle of shock hydrodynamics.

2. Description of the Prior Art

Various types of composite armor systems have been proposed for effectively resisting penetration by armor piercing projectiles and the like. Commonly, such systems comprise multiple layers of metal armor plates, with or without interposed non-metallic materials. Systems of this type primarily rely on deflection or evasion techniques induced by the configuration and/or physical makeup of the system's components.

The hull of a tank, for example, is normally constructed of steel armor plates or the like that are designed and shaped to provide protection against projectiles fired against it. It is common practice to slope the surfaces of the hull to increase the likelihood that a projectile will glance-off such surfaces. Protection of the tank's crew by relatively heavy armor plates is often-times found to be incompatible with adequate mobility and maneuverability of the tank. Thus, the tank designer has endeavored to effect a compromise between weight and mechanical performance with the weight of a conventional armor system normally comprising approximately one-third of the total weight of the tank.

SUMMARY OF THE INVENTION

An object of this invention is to provide a light weight and efficient shock destruction armor system for military vehicles and the like that functions to effectively defeat a long rod penetrator or shaped-charged jet by the principle of shock hydrodynamics.

In particular, the armor system is adapted to destroy the force of impact of a projectile having a length, L, equal to its aspect ratio, m, times its diameter, D. The armor system comprises a plurality of superimposed armor plates each having a predetermined thickness and separated one-from-another. The armor plates function to hydrodynamically and sequentially at least substantially destroy the projectile and induce debris generated from the explosion on an area of impact on one plate to egress from such area prior to impact of the projectile on the next-following armor plate. The shock destruction armor system of this invention is particularly adapted for use in military vehicles, such as tanks, personnel carriers, armored cars, self-propelled artillery, aircraft and ships. Various civilian uses are also contemplated, such as armored automobiles and satellites.

BRIEF DESCRIPTION OF THE DRAWINGS

Other objects and advantages of this invention will become apparent from the following description and accompanying drawings wherein.

DESCRIPTION OF THE PREFERRED EMBODIMENT

Figure 1:
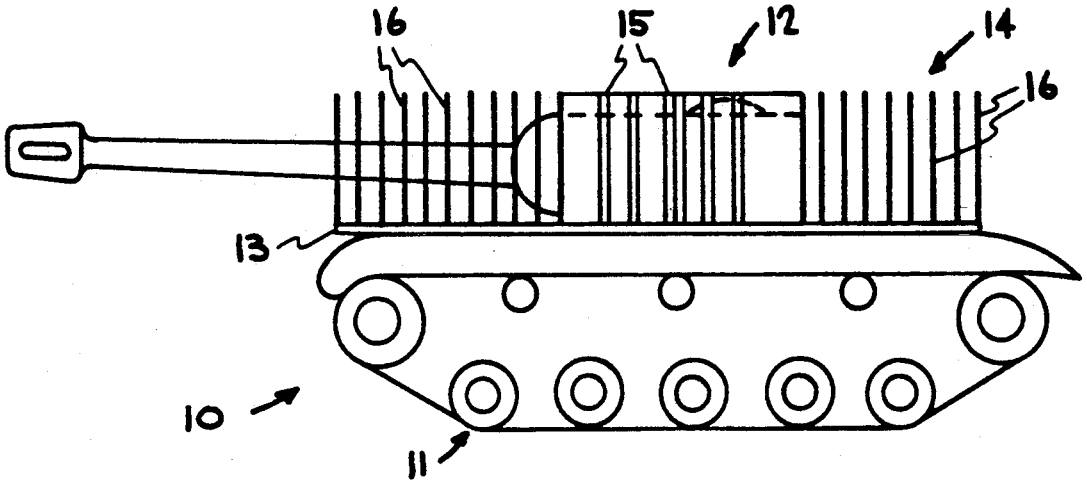
FIG. 1 is a side elevational view of a tank having a shock destruction armor system embodiment of this invention mounted thereon.
Figure 2:
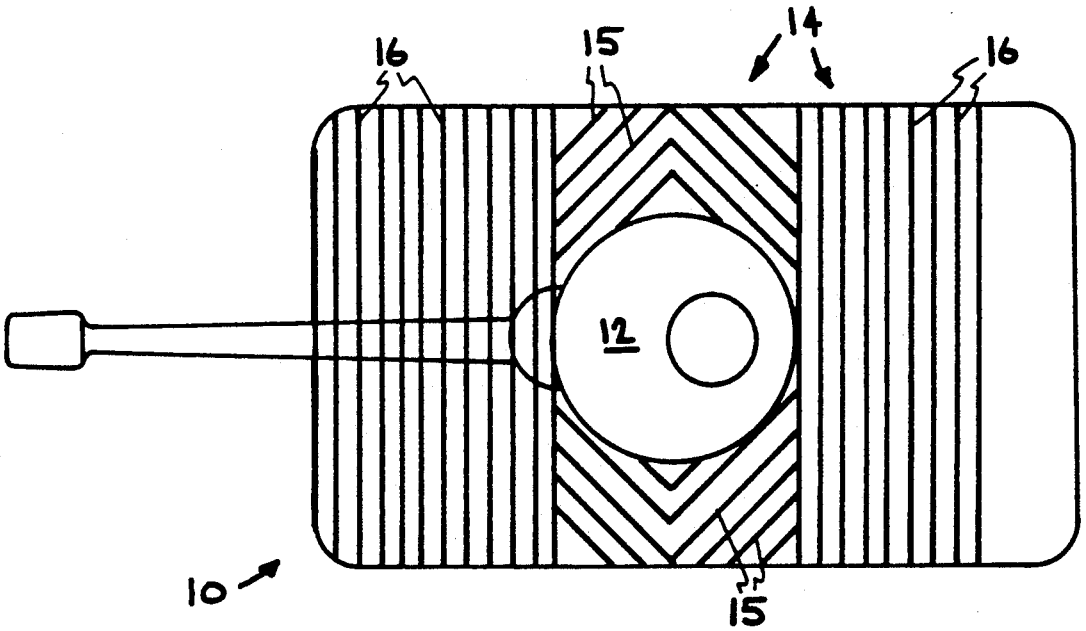
FIG. 2 is a top plan view of the tank showing one configuration of the armor system thereon.

FIGS. 1 and 2 schematically illustrate a tank 10 comprising a track-type undercarriage 11 having a revolving turret 12 suitably mounted thereon in a conventional manner. The turret is secured on a horizontally disposed platform 13 for simultaneous rotation therewith. A shock destruction armor system 14 of this invention is secured in upstanding relationship on the platform.

In the configuration illustrated, the armor system comprises first sets of armor plates 15 disposed on lateral sides of turret 12 and second sets of armor plates 16 disposed fore and aft of the turret. As described more fully hereinafter, the armor plates in each set are preferably disposed in at least substantial parallel relationship relative to each other and are suitably spaced one-from-another. Suitable openings (not shown) are formed through the plates to provide visual surveillance from the turret and to accommodate weaponry, in addition to the illustrated large caliber gun.

Figure 3:
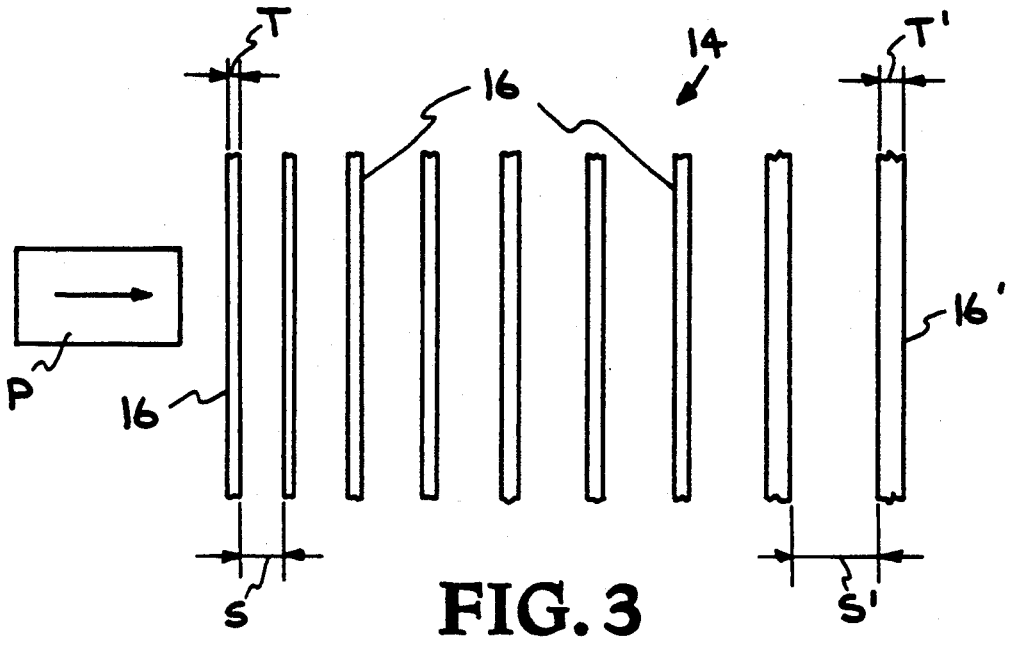
FIG. 3 schematically illustrates the construction and arrangement of a plurality of spaced armor plates employed in the armor system.

FIG. 3 illustrates an arrangement of armor system 14 wherein the thicknesses of one set of armor plates 16 and the separation distances between each adjacent pair of armor plates progressively increase from front to back. In particular, the thickness T of a frontal armor plate 16 is substantially less than the thickness T' of a last armor plate 16' of the illustrated set of nine armor plates. As shown, the intermediate armor plates preferably gradually and progressively increase in thickness from front to back. For example, the thicknesses of the frontal and last armor plate 16 and 16' may approximate 0.30 cm and 0.70 cm, respectively.

FIG. 3 further illustrates a separation distance S between frontal armor plate 16 and a second or next-following armor plate. As shown, the separation distances between each pair of adjacent armor plates gradually increase sequentially through a last distance S' between last armor plates 16' and its next-preceding armor plate. For example, distances S and S' can approximate 1.20 cm and 2.60 cm, respectively, for the specific design application illustrated.

The specific construction and arrangement of the plates for a particular armor system will depend on the particular application of the system, as will be appreciated by those skilled in the art. For example, the thicknesses of armor plates employed in armor systems for aircraft, satellites and like applications may be selected from the approximate range of from 0.01 cm to 0.10 cm whereas such thicknesses may approximate from 0.10 to 1.0 cm for military land vehicle applications. Armor plates used for military ships may have thicknesses approximating from 0.50 cm to 5.0 cm.

The armor plates may be composed of any standard material, such as hardened steel or other metallic or nonmetallic materials, either alone or in composite, suitable for armor plating purposes.

Figure 4:
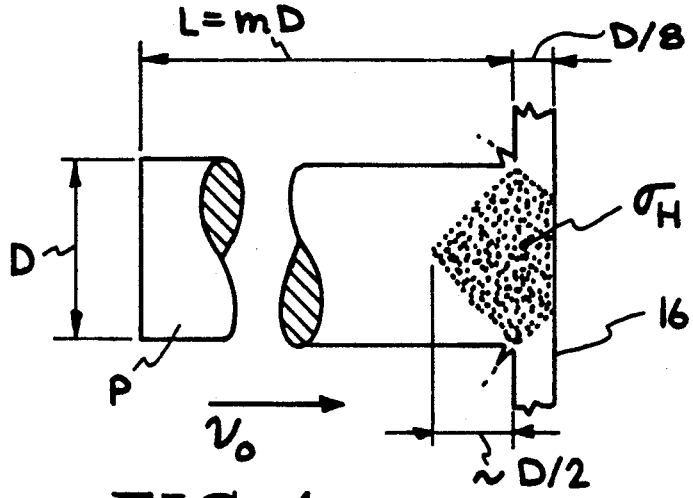
FIG. 4 is a theoretical view illustrating the impact of a projectile on one of the armor plates.

Referring to FIG. 4, when a rod-like projectile or penetrator P strikes a plate 16 at nearly normal incidence, a region is shocked to the Hugoniot stress which is typically well beyond the cohesive strength of the plate. The size of this region is limited by rarefactions from the periphery of the impact area, i.e., diameter, D, of the projectile and from the far surface of the plate. Thus, a plate having a thickness D/8 will destroy a portion of length, L, of the projectile equal to D/2. Increased thickness of the plate, beyond D/8, will contribute to a shortening of the projectile, but will do so in a substantially less efficient erosion mode. Destruction of a projectile, wherein L/D=m (aspect ratio; commonly twenty), will require n plates of thickness D/8, where n ≧2 m.

For example, to counteract a rod-like projectile twenty inches long, having a one inch diameter, composed of a standard W-alloy and fired at 1.5 km/s, a conventional armor plate would require a thickness of:

$$\geqq \sqrt{\frac{\rho_P}{\rho_T}}\, L$$

Where "$\rho_P$" is the projectile density and "$\rho_T$" is the plate density, or ~30 in. of steel (~600 g $cm^{-2}$).

In contrast thereto, a multi-plate array operating on the shock destruction principle of this invention would require substantially less weight to perform the same function. In particular, an equivalent armor system 14 would require approximately forty plates each composed of an aluminum alloy and each having a thickness of 0.3175 cm. Since the weight of a standard aluminum alloy approximates 35 $gcm^{-2}$, weight is reduced over the conventional steel plate armor by a factor approximating twenty.

Spacing of the plates must be sufficient to allow the debris from the explosion at one plate encounter to clear before the next plate is struck. Although a complex 2-D problem, it can be simplified by considering, as an initial condition, that the region described above (FIG. 4) is at a uniform stress $\sigma_H$ and that the pressure is zero elsewhere. Rarefaction waves will enter the shocked region and impart a disassembly velocity $\leqq 2u_H$, where $u_H$ is the Hugoniot material velocity at impact ($2\ u_H \approx v_O$). Time required is:

$$\Delta t_s = \Delta t \text{ Shock and Rarefaction} = \left(\frac{D}{2}\right)/c \times 2 \approx \frac{D}{c}$$

Where "c" is the speed of sound in the region.

The affected region now has a more or less isotropic velocity field whereby the average radial component may be estimated as approximately 0.25 $v_O$ allowing for the gradient from maximum at the outer boundary to zero on axis and other 2-D effects.

The time required for the region to disperse to approximately twice it's original radius (one-eighth of its original density) is:

$$\Delta t_D = \Delta t \text{ Dispersion} \approx \frac{\left(\frac{D}{2}\right)}{\left(\frac{v_0}{4}\right)} = 2\left(\frac{D}{v_0}\right)$$

The minimum separation distance (δ) required between the plates, is estimated to be $$\delta \geqq v_0(\Delta t_s + \Delta t_D)$$

$$\delta \geqq v_0\left(\frac{D}{c} + 2\frac{D}{v_0}\right) \text{but } c \geqq v_0, \text{ so:}$$

$$\delta \approx 2D$$

Since this invention involves destruction by shock rather than deflection, the impact should be nearly normal to the expected trajectory to effect the maximum results, i.e., at least substantial destruction of the projectile. The effects of departure from normal impact are not severe, so long as the lateral phase velocity of the contact between the projectile and plate is greater than the speed of sound. The situation is essentially one-dimensional and the full Hugoniot impact stress will be achieved.

Figure 5:
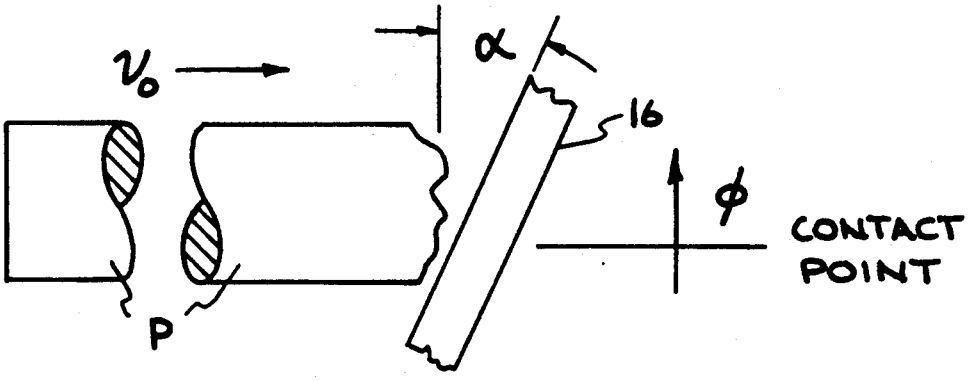
FIG. 5 is a theoretical view illustrating the near impact of a projectile at an oblique angle relative to an armor plate.

Referring to FIG. 5, it is seen that:

$$v_O\delta t = \phi\delta t \sin$$

So for $\phi \geqq c$:

$$\frac{V_0}{\sin\alpha} \geqq c; \leqq \sin^{-1}\frac{V_0}{c} \leqq \sim 15°$$

Otherwise stated, obliquities of up to ±15° should not deter the effectiveness of armor system 14.

Experimentation has shown an armor system embodying this invention will perform, as expected. For example, a suitably composed projectile having a length of 7.62 cm and a diameter of 0.762 cm was fired at an armor system 14 at a muzzle velocity of 1.60 km/s. The armor system constituted three standard-steel armor plates 16 ("LLNL TRIPLE") sequentially having thicknesses of 0.238 cm, 0.635 cm and 1.905 cm and spaced one-from-another at separation distances of 7.62 cm.

Radiographs showed that the first two plates destroyed approximately 1.524 cm of the projectile's length (two diameters) without adversely penetrating the third and last armor plate (1.905 cm thick). In comparison, a conventional solid steel armor plate, having a thickness of 5.08 cm, would be required to provide similar effectiveness.

Examples of plate materials include aluminum alloys (particularly for space applications), aluminum oxide, boron carbide, other ceramics, steel, other non-ferrous alloys, glass, and laminations or other combinations of these, or other materials.

I claim:

1. A shock destruction armor system mounted in a vertical relationship on an external surface of a vehicle for destroying the force of impact of an incoming projectile having a length, L, equal to an aspect ratio, m, times its diameter, D, said armor system comprising:

armor plate means, comprising a plurality of substantially vertical super-imposed armor plates secured at only one edge thereof to said vehicle, each of said armor plates having a predetermined thickness and separated one-from-another by a predetermined distance, said thickness of each of said armor plates progressively increasing from a frontal armor plate, adapted to receive the force of impact of an incoming projectile, to a last armor plate thereof, said distance between said armor plates progressively increasing from a first distance between said frontal armor plate and its next-following armor plate through a last distance between said last armor plate and its next-preceding armor plate, for hydrodynamically and sequentially at least substantially destroying an incoming projectile impacting a first of said armor plates, and for inducing debris generated from the explosion on an area of impact on the first armor plate to egress from such area prior to impact of such an incoming projectile on the next-following armor plate.

2. The armor system of claim 1 wherein the thickness of each of said armor plates is selected from the approximate range of from 0.01 D to 5.0 D.

3. The armor system of claim 2, wherein said distance is at least 0.5 D.

4. The armor system of claim 2, wherein said distance is selected from the approximate range of from 0.5 D to 2.5 D.

5. The armor system of claim 3 wherein said thickness is selected from the approximate range of from 0.01 cm to 0.10 cm.

6. The armor system of claim 3 wherein said thickness is selected form the approximate range of from 0.10 cm to 1.0 cm.

7. The armor system of claim 3 wherein said thickness is selected from the approximate range of from 0.5 cm to 5.0 cm.

8. The armor system of claim 3 wherein at least three of said armor plates are disposed in parallel relationship relative to each other.

9. The armor system of claim 1 wherein the thicknesses of said frontal and last armor plates are approximately 0.30 cm and 0.70 cm, respectively.

10. The armor system of claim 9 wherein said first and last distances approximate 1.20 cm and 2.60 cm, respectively.

11. The armor system of claim 1 wherein said vehicle comprises a tank having an undercarriage and a revolving turret mounted on said undercarriage and secured on a platform, said armor plates including first sets of armor plates disposed on lateral sides of said turret and second sets of armor plates disposed fore and aft of said turret.

12. The armor system of claim 11, wherein said first sets of armor plates positioned on lateral sides of said turret are positioned at an angle with respect to said second sets of armor plates.

13. The armor system of claim 12, wherein said first sets of armor plates comprises four armor plate sets with two sets of said four sets being located on opposite sides of said turret.

14. The armor system of claim 13, wherein each set of said two sets of armor plates is positioned such that each set is at an angle with respect to the other set.

15. The armor system of claim 11, wherein each set of said second sets of armor plates are positioned in a substantially parallel arrangement with another set of said second sets of armor plates.

16. The armor system of claim 15, wherein said first sets of armor plates comprises two pairs of sets of armor plates, each pair of sets of armor plates being positioned on opposite sides of said turret.

17. The armor system of claim 16, wherein each set of said pairs of sets of armor plates is positioned at an angle with respect to another set of said pairs of sets of armor plates.

18. The armor system of claim 17, wherein one end of each armor plate of each set of each pair of sets of armor plates is in contact with one end of an armor plate of the other set of the pair of sets of armor plates.

19. The armor system of claim 18, wherein said ends of said armor plates are in contact with one another so as to define a V-shaped configuration, with a point of the V of each pair of contacting armor plates extending in a direction away from said turret.

* * * * *